US006812921B2

(12) United States Patent
Hsu

(10) Patent No.: US 6,812,921 B2
(45) Date of Patent: Nov. 2, 2004

(54) POWER-SAVING CIRCUIT AND METHOD FOR LIGHT SOURCES OF A DISPLAY DEVICE

(75) Inventor: Alpha Hsu, Taipei (TW)

(73) Assignee: Mitac International Corp., Hsinchu (TW)

( * ) Notice: Subject to any disclaimer, the term of this patent is extended or adjusted under 35 U.S.C. 154(b) by 281 days.

(21) Appl. No.: 10/043,890

(22) Filed: Jan. 10, 2002

(65) Prior Publication Data

US 2002/0149690 A1 Oct. 17, 2002

(51) Int. Cl.[7] ..... G09G 5/00

(52) U.S. Cl. ..... 345/211; 345/87; 345/102; 348/730; 713/300

(58) Field of Search ..... 345/211, 212, 345/102, 213, 88, 89; 348/730; 713/300

(56) References Cited

U.S. PATENT DOCUMENTS 4,555,170 A * 11/1985 Wakui et al. ..... 396/282
5,105,127 A * 4/1992 Lavaud et al. ..... 315/291
5,847,702 A * 12/1998 Jung ..... 345/211
6,020,879 A * 2/2000 Nakabayashi ..... 345/212
6,184,875 B1 * 2/2001 Matsuura ..... 345/211
6,226,472 B1 * 5/2001 Yun ..... 399/81
6,300,931 B1 * 10/2001 Someya et al. ..... 345/102

* cited by examiner

*Primary Examiner*—Henry N. Tran
(74) *Attorney, Agent, or Firm*—Merchant & Gould P.C.

(57) ABSTRACT

A power-saving circuit for a light source of a LCD monitor is disclosed. The power-saving circuit indirectly controls the on-off state of the light source by controlling the driving circuit of the light source. The power-saving circuit includes a control signal generator and a switching device. The control signal generator produces a low-frequency periodic control signal, the frequency of which is higher than a switching frequency of frames of the monitor. The switching device is coupled between the control signal generator and the driving circuit and used for alternatively controlling the on-off state of the light source by controlling the operation of the driving circuit.

13 Claims, 4 Drawing Sheets

POWER-SAVING CIRCUIT AND METHOD FOR LIGHT SOURCES OF A DISPLAY DEVICE

BACKGROUND OF THE INVENTION

1. Field of the Invention

The present invention is related to a power-saving circuit and method for light sources of a liquid crystal display (hereafer called LCD), and more specifically to a power-saving circuit and method for controlling a driving circuit of a light source converter.

2. Description of the Prior Art

Commercial monitors are generally categorized into two types, cathode ray tube (hereafter called CRT) monitors and LCD monitors. The CRT monitor displays an image by accelerating electron beams to bombard phosphor powders coated on a screen Therefore, no external light source is required for the CRT monitor. On the other hand, the LCD monitor displays an image by utilizing side-light sources or backlight sources to illuminate liquid crystal molecules sandwiched between glass substrates and polarizing filters. Thus an extra light source is necessary for the display of the LCD monitors.

Generally speaking, the power consumption of the LCD monitors is lower than that of the CRT monitors. In addition, the LCD monitors have several advantages, such as light weight, small size and planarization, and so on. Therefore, the market share of the LCD monitors is gradually increasing. In a LCD monitor, the components that consume a majority of the power include the active matrix array composed of thin-film transistors (TFT) and the light sources and its driving circuit. As described above, the screen of the LCD monitor itself does not illuminate and the LCD monitor utilizes a sidelight source or a backlight source to illuminate the arranged liquid crystal molecules to produce images. Accordingly, the power consumption of the LCD monitor can be further reduced by saving the power consumed by the light source circuitry.

SUMMARY OF THE INVENTION

Therefore, the objective of the present invention is to provide a power-saving circuit and method for driving the light sources of a LCD monitor without sacrifying its visual effect.

The present invention achieves the above-indicated objects by providing a power-saving circuit for a light source of a monitor, such as an LCD monitor. The power-saving circuit indirectly controls the on-off state of the light source by controlling the the driving circuit of the light source. The power-saving circuit includes a control signal generator and a switching device. The control signal generator produces a low-frequency periodic control signal, the frequency of which is higher than a switching frequency of frames of the monitor. For example, the period of the control signal can be set as 10 ms~20 ms. The switching device is coupled between the control signal generator and the driving circuit and used for alternatively controlling the on-off state of the light source by controlling the operation of the driving circuit.

In addition, there are two schemes for the switching device to control the driving circuit. In the first scheme, the switching device, which is coupled to the control signal generator, the power source and the power-in terminal of the driving circuit, alternatively enables and disables a power path between the power source and the power-in terminal of the driving circuit in response to the control signal from the control signal generator. For example, the power path can be grounded for cutting off the power supply. In the second scheme, the switching device, which is coupled to the control signal generator and the driving circuit, alternatively enables and disables the output of the driving signal from the driving circuit in response to the control signal from the control signal generator. For example, the driving signal can be disabled by bypassing.

BRIEF DESCRIPTION OF THE DRAWINGS

The following detailed description, given by way of example and not intended to limit the invention solely to the embodiments described herein, will best be understood in conjunction with the accompanying drawings, in which.

DETAILED DESCRIPTION OF THE INVENTION

First Embodiment

The power-saving circuit of present invention achieves the objective of the present invention by controlling the driving circuit for the lamp converter of the LCD monitor. More specifically, the power supplied to the driving circuit is alternatively turned on or turned off, thereby quickly switching the lamp on and off. In this embodiment, this operational mode is called the switching mode. On the contrary, the conventional mode is called the continuous mode. The utilization of the switching mode for controlling the driving circuit can make the converter in the last stage (including feedback transformers) and the lamp be operated in a discontinuous scheme, thereby reducing the consumed power.

Figure 1A:
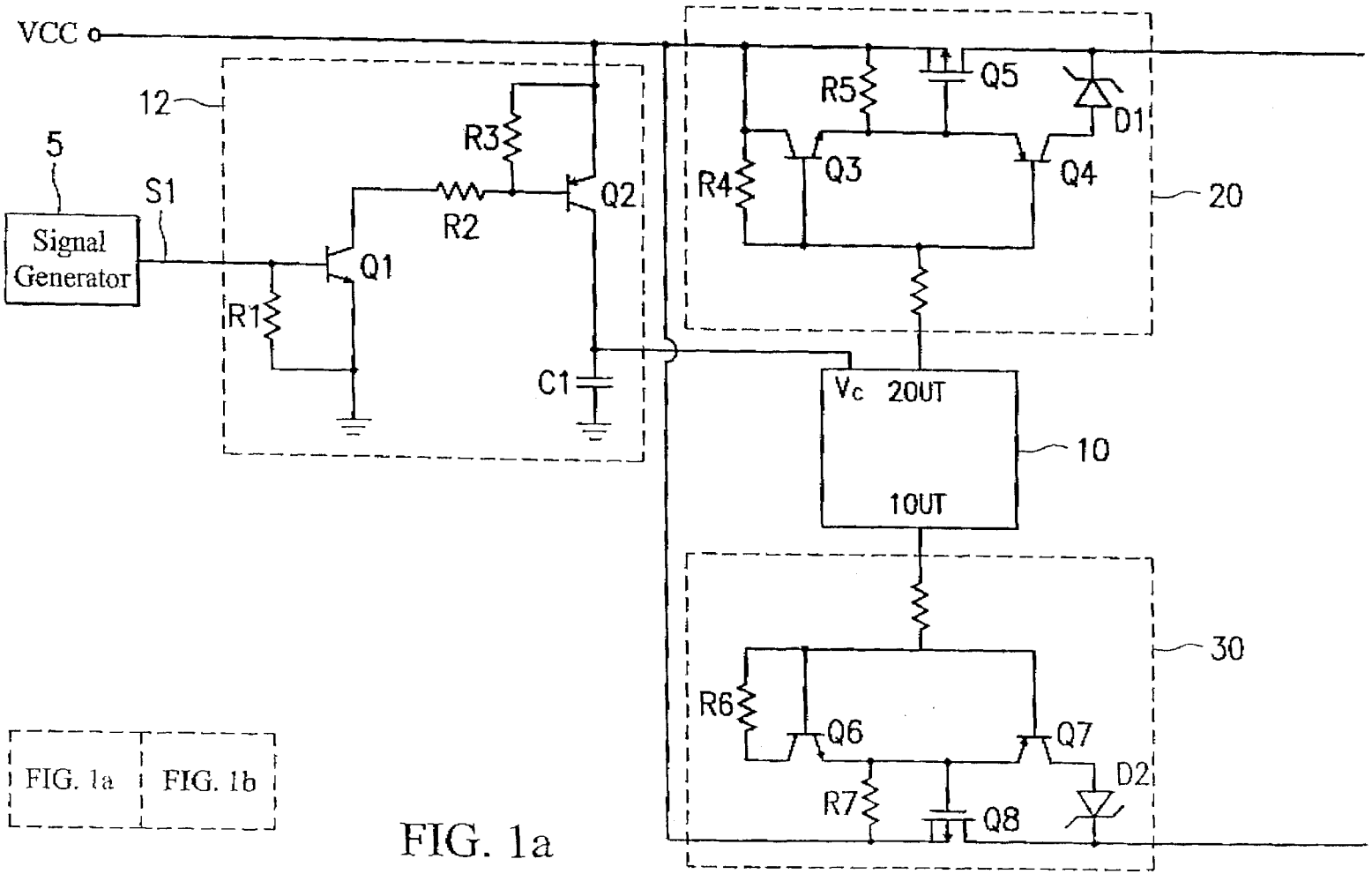
FIGS. 1*a* and 1*b* illustrate a circuit diagram of the power-saving circuit for the light source of the LCD monitor according to the first embodiment of the present invention.
Figure 1B:
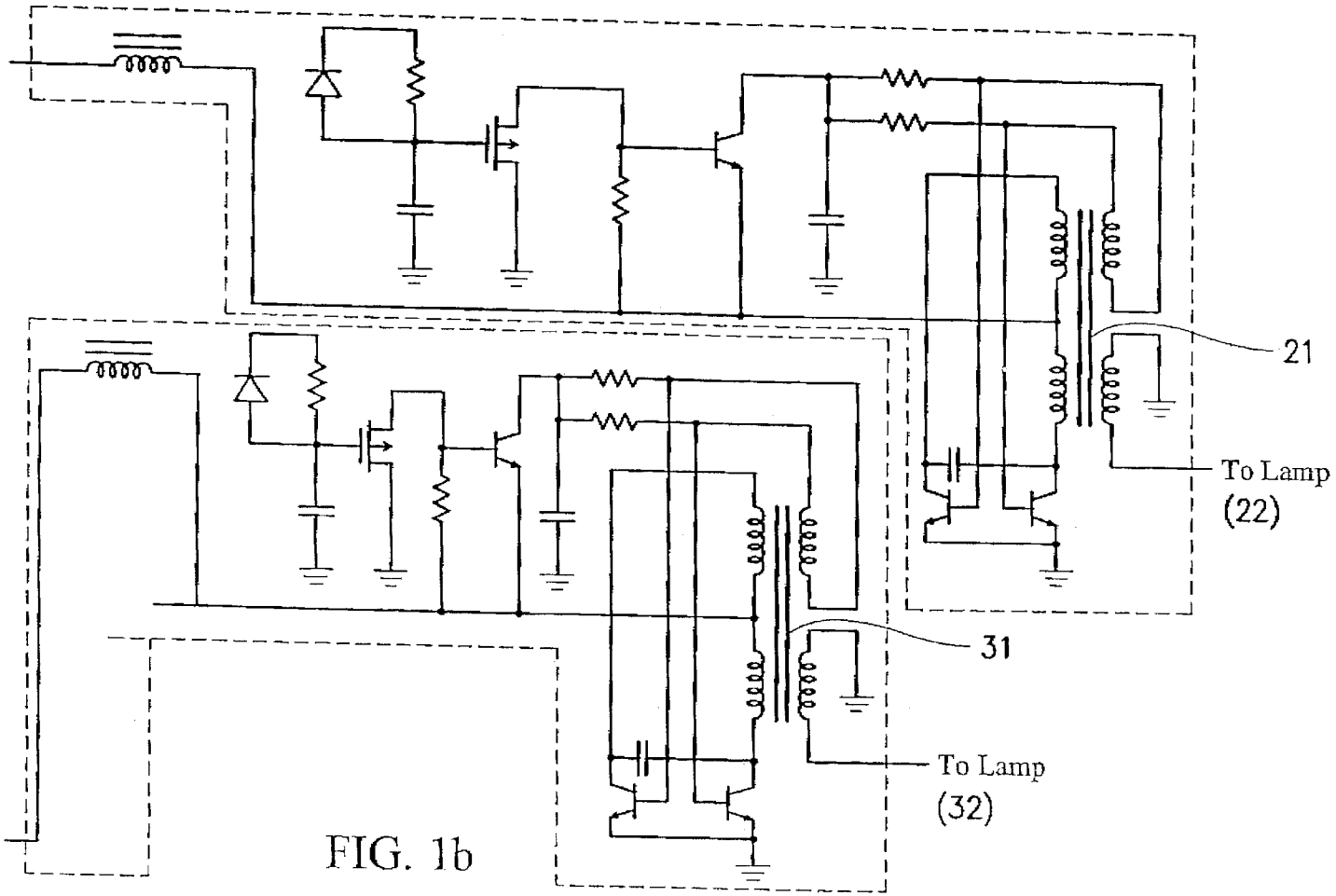

FIGS. 1*a* and 1*b* illustrate a circuit diagram of the power-saving circuit for the light source of the LCD monitor according to the present embodiment. In FIG. 1*a*, driving circuit 10 and driving-gate circuits 20 and 30 are conventional. The driving circuit 10 is used to drive converter circuits 21 and 31 in the post stage and the lamps 22 and 32, while the converter circuits 21 and 31 include corresponding feedback transformers and supply driving currents to the lamps 22 and 32, In this embodiment, the driving circuit 10 can be implemented by the IC TL1451A made by the Texas Instruments, which is a pulse-width-modulation (PWM) power control circuit with a pin count of 16. FIG. 1*a* only demonstrates the three pins of the IC utilized in the present embodiment, which are denoted by VC, 1OUT and 2OUT. The pin VC is coupled to an external voltage source VCC, which is set as 12V in the present embodiment, for supplying the power of the IC. The pins 1OUT and 2OUT are used to output PWM control signals or driving signals. The signals outputted from the pins 1OUT and 2OUT are sent to the driving-gate circuits 20 and 30 for controlling the generation of voltages VOUT1 and VOUT2, which are supplied to the converters and the lamps in the post stage. The driving-gate circuit 20 includes resistors R4~R5, transistors Q3~Q5 and a zener diode DI. The driving-gate circuit 30 includes resistors R6~R7, transistors Q6~Q8 and a zener diode D2. Thus, in the conventional LCD lamp circuit, the voltage source VCC is directly supplied to the driving circuit 10 and the driving cirucit 10 further drives the converters and the lamps serving as the display light source.

Figure 2:
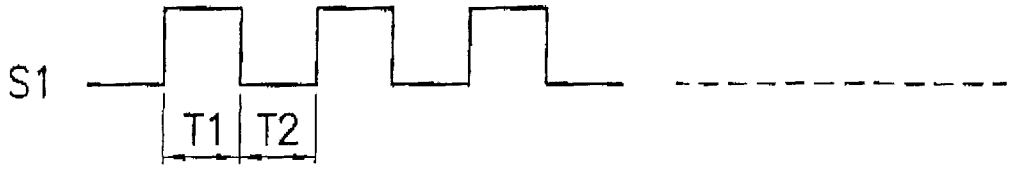
FIG. 2 illustrates an example of the control signal S1 in the first embodiment of the present invention.

The power-saving circuit of the present embodiment includes a signal generator 5 and a switching device 12 shown in FIG. 1*a*, which is used to control the power supply to the pin VC of the driving circuit 10. The signal generator 5 generates and transmits a low-frequency control signal S1 to the switching device 12. FIG. 2 illustrates an example of the control signal S1. As shown in FIG. 2, the control signal S1 is a periodic signal with a high voltage of 5V and a low voltage of 0V. In this embodiment, the periods of the high voltage and low voltage of the control signal S1 are about 5 ms, respectively. Accordingly, the control signal S1 can be regarded as a square wave of 100 Hz. In addition, the signal generator 5 can be implemented by a square wave generator.

The switching device 12 is used to control the state of the power path between the voltage source VCC and the pin VC of the driving circuit 10. The switching device 12 inlcudes an NPN transistor Q1, a PNP transistor Q2, resistors R1~R3 and a capacitor C1. The NPN transistor Q1 and the PNP transistor Q2 are emitter-grounded, The NPN transistor Q1 is used to provide a grounding path for bypassing the current, When the control signal S1 is in the high-voltage state (5V), the NPN transistor Q1 turns on and the current from the voltage source VCC to the pin VC of the driving circuit 10 is bypassed. Thus, the power of the driving circuit 10 is off. When the control signal S1 is in the low-voltage state (0V), the NPN transistor Q1 turns off and the voltage source VCC can normally supply the current to the driving circuit 10. Since the driving cirucit 10 alternatively works or halts in response to the control signal S1, the output of the driving signals from the terminals 1OUT and 2OUT is discontinuous and the lamp is operated in the switching mode. In the present embodiment, the lamps 22 and 32 are operated in phase, that is, simultaneously turned on or off. Thus, the power consumption of the lamps can be effectively reduced, When the lamps in the present embodiment are operated in the switching mode, however, the switching frequency should not be so low as to flicker the images on the LCD monitor. Generally speaking, the display of the monitor also flickers in the frame switching frequency, which is in the range of 50 Hz to 60 Hz and determined by the persistence of vision for human eyes. In addition, the persistent period of images on the LCD monitor is longer than that of the CRT monitor and thus the flickering effect for the LCD monitor is not so apparent, In the present embodiment, the on-off switching frequency of the lamps operated in the switching mode is determined by the frequency of the control signal S1, Thus, the frequency of the control signal S1 is preferably set to be higher than the frame switching frequency of the monitor, thereby preventing from the deterioration of the visual quality. On the other hand, the on-off switching frequency is preferably not so high as to affect the normal operation of the driving circuit 10. For example, the period of the on-off switching could be set as 10 ms~20 ms. In addition, as described above, the persistent period of the images on the LCD monitor is quiet long, which facilitates the reduction of the image flickers caused by the switching operations of the lamps.

Figure 3:
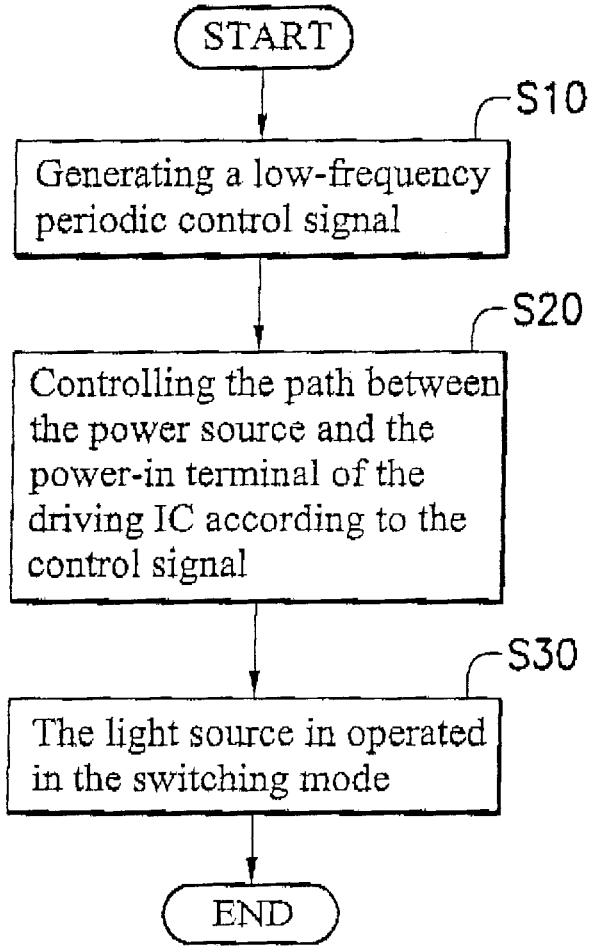
FIG. 3 is a flowchart of the power-saving method utilized in the LCD montior in the first embodiment of the present invention.

FIG. 3 is a flowchart of the power-saving method utilized in the LCD montior in the present embodiment. First, a square-wave generator is used to generate a low-frequency periodic control signal (step S10). The frequency of the control signal should not be lower than the inherent frame switching frequency of the monitor, thereby preventing the deterioration of the visual quality. Next, the control signal is used to control the path between the voltage source and the power-in terminal of the driving circuit and the power current is switched between the ground and the driving circuit (step S20). At this time, the power supplied to the driving circuit is discontinuous and the light source is operated in the switching mode (step S30). Therefore, the power consumed by the light source circuitry is reduced.

Second Embodiment

The present embodiment adopts a control scheme that is slightly different from that of the first embodiment. In the first embodiment, the power supplied to the driving circuit is controlled for switching the on-off state of the lamps, while in the present embodiment, the output of the driving signals generated by the driving circuit is controlled for switching the on-off state of the lamps.

Figure 4:
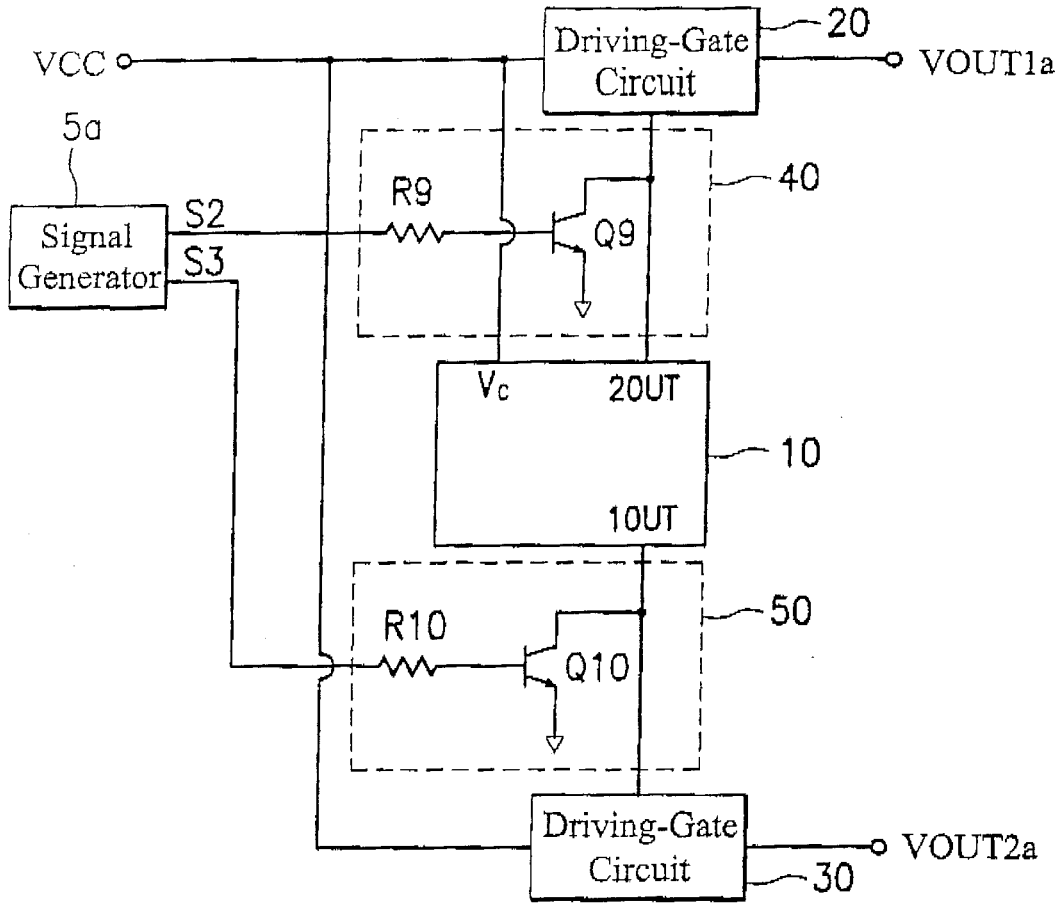
FIG. 4 is s a circuit diagram of the power-saving circuit for the light source of the LCD monitor according to the second embodiment of the present invention.
Figure 5:
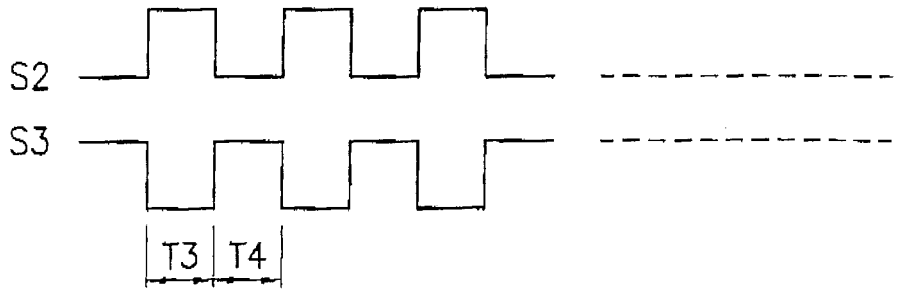
FIG. 5 illustrates an example of the control signals S2 and S3 in the second embodiment of the present invention.

FIG. 4 is a circuit diagram of the power-saving circuit for the light source of the LCD monitor according to the present embodiment. The power-saving circuit includes a signal generator 5*a* and switching devices 40 and 50 shown in FIG. 4, which is mainly used to control the output of the driving signals from the pins 1OUT and 2OUT of the driving circuit 10. The signal generator 5*a* generates two low-frequency control signals S2 and S3, which are transmitted to the switching devices 40 and 50, respectively. FIG. 5 illustrates an example of the control signals S2 and S3. The control signal S2 is the same as the control signal S1 shown in FIG. 2, and the control signals S2 and S3 are complementary. In the present embodiment, the period T2 of the high voltage of the control signal S2 or the low voltage of the control signal S3 is about 5 ms and the period T4 of the low voltage of the control signal S2 or the high voltage of the control signal S3 is also about 5 ms. Thus, the circuitry of generating the control signal S2 can be implemented by a square-wave generator and the circuitry of generating the control signal S3 can be an inverter.

The switching devices 40 and 50 are used to control the output of the driving signals from the pins 2OUT and 1OUT of the driving circuit 10 based on the control signals S2 and S3. The switching device 40, which includes a transistor Q9 and a resistor R9, and the switch device 50, which includes a transistor Q10 and a resistor R10, provide grounding paths for the pins 2OUT and 1OUT, respectively. The operation of the switching device 40 is illustrated as follows. When the control signal S2 is in the high-voltage state (5V), the transistor Q9 turns on and the control signal from the pin 2OUT of the driving circuit 10 is bypassed. Thus, the corresponding lamp is turned off. When the control signal S2 is in the low-voltage state (0V) the transistor Q9 turns off and the driving signal from the pin 2OUT is normally sent to the driving-gate circuit 20 and the corresponding lamp is turned on. Accordingly, the object of switching the on-off state of the lamp is achieved, The operation of the switching device 50 is fundamentally the same as that of the switching device 40. However, the on-off states of the lamps controlled by the switching devices 40 and 50 are out of phase since the control signals S2 and S3 are complementary. In addition, the determination of the frequency of the control signals are the same as that of the first embodiment.

It is noted that the operational principles of the first embodiment and the second embodiment are similar. Thus, the on-off state of the lamp is indirectly controlled by controlling the operation of the driving circuit, thereby reducing the implementation cost and achieving a good power-saving effect.

While the invention has been described by way of example and in terms of the preferred embodiment, it is to be understood that the invention is not limited to the disclosed embodiments. On the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A power-saving circuit for a light source of a monitor, the monitor having a power source and a driving circuit for the light source, the power source supplying power to a power-in terminal of the driving circuit and the driving circuit driving the light source of the monitor using the power supplied from the power-in terminal, comprising:

a generator for generating a control signal, which is a low-frequency periodic signal, the frequency of the control signal being higher than a switching frequency of frames of the monitor; and a switching device, coupled to the generator, the power source and the power-in terminal of the driving circuit, for alternatively enabling and disabling a power path between the power source and the power-in terminal of the driving circuit in response to the control signal from the generator.

2. The power-saving circuit as recited in claim 1, wherein the monitor is a liquid crystal display monitor.

3. The power-saving circuit as recited in claim 1, wherein the period of alternatively enabling and disabling the power path by the switching device is about between 10 ms and 20 ms.

4. The power-saving circuit as recited in claim 1, wherein the switching device provides a grounding path for disabling the power path between the power source and the power-in terminal of the driving circuit.

5. The power-saving circuit as recited in claim 1, wherein the light source has two independent lamps that turn on in phase.

6. A power-saving circuit for a light source of a monitor, the monitor having a power source and a driving circuit for the light source, the driving circuit transmitting a driving signal from an output terminal thereof for controlling a driving-gate circuit connected between the power source and the light source, comprising:

a generator for generating a control signal, which is a low-frequency periodic signal, the frequency of the control signal being higher than a switching frequency of frames of the monitor; and a switching device, coupled to the generator and the output terminal of the driving circuit, for alternatively enabling and disabling the driving signal for controlling the driving-gate circuit in response to the control signal from the generator.

7. The power-saving circuit as recited in claim 6, wherein the monitor is a liquid crystal display monitor.

8. The power-saving circuit as recited in claim 6, wherein the period of alternatively enabling and disabling the driving signal by the switching device is about between 10 ms and 20 ms.

9. The power-saving circuit as recited in claim 6, wherein the switching device provides a grounding path for disabling the driving signal.

10. The power-saving circuit as recited in claim 6, wherein the light source has a first independent lamp and a second independent lamp and the control signal includes a first control signal and a second control signal, the first control signal and the second control signal are complementary for alternatively turning on and off the first independent lamp and the second independent lamp.

11. A power-saving method for a light source of a monitor, the monitor having a driving circuit for driving the light source of the monitor, comprising the steps of:

generating a control signal, which is a low-frequency periodic signal, during a power-saving mode, the frequency of the control signal being higher than a switching frequency of frames of the monitor; and alternatively switching on and off the power source to the light source under the control of the driving circuit in response to the control signal.

12. The power-saving method as recited in claim 11, wherein the monitor is a liquid crystal display monitor.

13. The power-saving method as recited in claim 11, wherein the period of the control signal is about between 10 ms and 20 ms.

* * * * *